US012377514B2

(12) United States Patent
Vien

(10) Patent No.: US 12,377,514 B2
(45) Date of Patent: Aug. 5, 2025

(54) CARRIER AND METHOD FOR MANUFACTURING SUBSTRATE

(71) Applicants: HOYA CORPORATION, Tokyo (JP); HOYA GLASS DISK VIETNAM LTD., Hanoi (VN)

(72) Inventor: Tam Dinh Vien, Hanoi (VN)

(73) Assignees: HOYA CORPORATION, Tokyo (JP); HOYA GLASS DISK VIETNAM LTD., Hanoi (VN)

( * ) Notice: Subject to any disclaimer, the term of this patent is extended or adjusted under 35 U.S.C. 154(b) by 312 days.

(21) Appl. No.: 17/914,292

(22) PCT Filed: Mar. 26, 2021

(86) PCT No.: PCT/JP2021/013124
§ 371 (c)(1),
(2) Date: Sep. 23, 2022

(87) PCT Pub. No.: WO2021/193970
PCT Pub. Date: Sep. 30, 2021

(65) Prior Publication Data

US 2023/0110750 A1 Apr. 13, 2023

(30) Foreign Application Priority Data

Mar. 26, 2020 (VN) ..... 1-2020-01787

(51) Int. Cl.
*B24B 37/28* (2012.01)
*B24B 37/08* (2012.01)

(52) U.S. Cl.
CPC ..... *B24B 37/28* (2013.01); *B24B 37/08* (2013.01)

(58) Field of Classification Search
CPC ..... B24B 37/28; B24B 37/27; B24B 37/08
(Continued)

(56) References Cited

U.S. PATENT DOCUMENTS 5,914,053 A * 6/1999 Masumura ..... H01L 21/02024 216/88
6,454,635 B1 * 9/2002 Zhang ..... B24B 37/28 451/41

(Continued)

FOREIGN PATENT DOCUMENTS

JP 2003-225857 A 8/2003
JP 2019-058994 A 4/2019
KR 100879758 B1 * 1/2009 ..... B24B 37/08

OTHER PUBLICATIONS

Lee, KR-100879758-B1 machine translation, Jan. 21, 2009 (Year: 2009).*

(Continued)

*Primary Examiner* — Brian D Keller
*Assistant Examiner* — Marcel T Dion
(74) *Attorney, Agent, or Firm* — Global IP Counselors, LLP

(57) ABSTRACT

A carrier has a plate-shaped carrier body that has an inner hole and is made of a first material, and an insertion member that is shaped such that the insertion member fits between the substrate and an inner circumference of the inner hole, that has a substrate holding hole, and that is made of a second material that is different from the first material. The insertion member has a region that bulges toward the carrier main body side, and when a radius of an inscribed circle inscribed to an inner circumference of the substrate holding hole of the insertion member is R, the center of gravity of the insertion member is located 0.1×R or more away from the center of an inner circumferential shape of the substrate holding hole of the insertion member.

15 Claims, 5 Drawing Sheets

(58) Field of Classification Search
USPC ..... 451/398, 397
See application file for complete search history.

(56) References Cited

U.S. PATENT DOCUMENTS

| | | | | |
|---|---|---|---|---|
| 2012/0156970 | A1* | 6/2012 | Pietsch | B24B 37/28 451/41 |
| 2013/0143472 | A1* | 6/2013 | White, Jr. | B24B 37/28 451/28 |
| 2019/0084122 | A1* | 3/2019 | Nishimura | B24B 37/042 |
| 2019/0160627 | A1* | 5/2019 | Mikuriya | B24B 49/00 |
| 2020/0365387 | A1* | 11/2020 | Mikuriya | H01L 21/02024 |

OTHER PUBLICATIONS

International Search Report in PCT/JP2021/013124 dated Jun. 1, 2021.

* cited by examiner

CARRIER AND METHOD FOR MANUFACTURING SUBSTRATE

CROSS-REFERENCE TO RELATED APPLICATIONS

This U.S. National stage application of International Patent Application No. PCT/JP2021/013124, filed on Mar. 26, 2021, which, in turn, claims priority to Vietnamese Patent Application No. 1-2020-01787, filed in Viet Nam on Mar. 26, 2020. The entire contents of Vietnamese Patent Application No. 1-2020-01787 are hereby incorporated herein by reference.

BACKGROUND

Field of the Invention

The present invention relates to a carrier that holds a substrate being subjected to polishing or grinding processing, and a method for manufacturing a substrate in which polishing processing or grinding processing is performed using the carrier.

Background Information

Nowadays, in order to record data, hard disk drives (HDDs) are incorporated in personal computers, DVD (Digital Versatile Disc) recording apparatuses, and the like.

A magnetic disk obtained by providing a magnetic layer on a substrate is used in a hard disk drive, and magnetic recording information is recorded in, or read from, the magnetic layer by using a magnetic head that is made to float slightly above the surface of the magnetic disk. Magnetic recording density has been increased in order to increase the storage capacity of hard disk drives. In order to be able to increase the magnetic recording density, surface unevenness of main surfaces of a substrate to be used as a substrate of a magnetic disk is minimized as much as possible. Therefore, high precision polishing is performed in the production of a substrate used for a magnetic disk.

A polishing apparatus, for example, polishes the main surfaces of a substrate with polishing pads while holding the substrate between upper and lower surface plates provided with the polishing pads and rotating the upper and lower surface plates. At this time, a polishing liquid is supplied between the polishing pads and the main surfaces of the substrate.

In the polishing apparatus, substrates are held respectively in a plurality of, for example, five substrate holding holes that are provided in a flat plate-shaped carrier, the carrier is sandwiched between the upper and lower surface plates provided with the polishing pads on their surfaces, and main surfaces of the substrates are polished by moving the carrier relative to the upper and lower surface plates while the polishing liquid is supplied between the upper and lower surface plates.

In recent years, in order to increase the number of magnetic disks incorporated in hard disk drives, there is a trend for the magnetic-disk substrates to be thin, and a substrate having a thickness of 0.7 mm or less is known, for example. Thus, a carrier used in a polishing apparatus needs to be thin. On the other hand, a decrease in the rigidity of a carrier caused by making the carrier thin leads to undesired deformation of the carrier during polishing processing, and thus a metal material such as stainless steel is used as the material of the carrier in order to ensure the rigidity of the carrier. In this case, because the carrier is made of a metal material, the surface of the carrier is hard, and an outer circumference of a substrate is likely to be blemished or chipped due to the outer circumference coming into contact with the surface of the carrier. Thus, in order to protect the outer circumference of the substrate, annular insertion members made of a resin material are disposed on inner circumferences of the substrate holding holes of the carrier made of metal.

A carrier is known which includes a holding member main body provided with a holding portion, which is an annular insertion member having a holding hole for holding an object to be polished, such as a substrate, and a core portion to which the holding portion is attached, in which the holding portion is formed from a material that is different from that of the core portion, and the holding portion is formed from an organic fiber laminate formed by laminating organic fiber base members impregnated with resin (JP 2003-225857A), for example.

SUMMARY

However, when an upper surface plate and a lower surface plate are opened in order to remove the substrates after polishing processing has ended, there are cases where the holding portion, which is an insertion member, is separated from the core portion and attached to the upper surface plate. Usually, the above-described holding portion is smaller in volume and weight than the above-described core portion, which is a carrier main body. Also, there are circumstances where it is difficult to firmly fix the holding portion to the core portion because the width of the contact surfaces thereof is small. If only the holding portion is attached to the upper surface plate, the productivity is reduced because the holding portion needs to be fitted to the core portion again. Also, this attachment is not desirable because there are cases where the attached holding portion falls onto the substrate and blemishes the surface of the processed substrate.

In view of this, the present invention aims to provide a carrier for polishing by which, when processing for polishing main surfaces of a substrate is performed while the carrier provided with an insertion member between the substrate and an inner circumference of an inner hole of a carrier main body is sandwiched between an upper surface plate and a lower surface plate, attachment of the insertion member to the upper surface plate can be suppressed, and to provide a method for manufacturing a substrate in which polishing processing is performed using this carrier for polishing.

Solution to Problem

One aspect of the present invention is a carrier that is provided with a substrate holding hole and is configured to hold a substrate in the substrate holding hole and to be used in polishing processing for polishing a main surface of the substrate, the carrier including:

- a plate-shaped carrier main body that has an inner hole and is made of a first material; and
- an insertion member that is shaped such that the insertion member fits between the substrate and an inner circumference of the inner hole, that has the substrate holding hole for holding the substrate, and that is made of a second material that is different from the first material,
- in which the insertion member has a region that bulges toward the carrier main body side, and when a radius of an inscribed circle inscribed to an inner circumference of the substrate holding hole of the insertion member is R, a center of gravity of the insertion member is located 0.1×R or more away from a center of an inner circumferential shape of the substrate holding hole of the insertion member.

It is preferable that hardness of the second material is lower than that of the first material.

It is preferable that a size of the region is smaller than a size of the substrate.

It is preferable that a length occupied by the region extending along the inner circumference of the substrate holding hole is 5% to 50% of the entire circumferential length of the inner circumference.

It is preferable that the region is provided with a through-hole passing through the insertion member in a thickness direction of the insertion member.

It is preferable that the first material contains metal, and the second material contains resin.

It is preferable that the insertion member and the carrier main body are fixed to each other through adhesion using an adhesive, or engagement between a recess and a protrusion in a thickness direction, at portions where the insertion member and the carrier main body are in contact with each other.

Another aspect of the present invention is a method for manufacturing a substrate including polishing processing for polishing a main surface of a substrate using a carrier that is provided with a substrate holding hole and is configured to hold a substrate in the substrate holding hole, and the carrier is the carrier for polishing.

According to the above-described carrier for polishing and the above-described method for manufacturing a substrate in which polishing processing is performed using the carrier for polishing, when processing for polishing main surfaces of a substrate is performed while the carrier provided with an insertion member between the substrate and an inner circumference of an inner hole of a carrier main body is sandwiched between an upper surface plate and a lower surface plate, it is possible to suppress attachment of the insertion member to the upper surface plate.

DETAILED DESCRIPTION OF THE EMBODIMENTS

The following describes a carrier for polishing according to an embodiment and a method for manufacturing a substrate in which polishing processing is performed using this carrier for polishing, with reference to the drawings.

"Polishing" with a carrier for polishing in this specification includes polishing for performing fine and precise processing to adjust surface unevenness of main surfaces of a substrate, including an arithmetic average roughness Ra (JIS B0601 2001) and a maximum height Rz (JIS B0601 2001) etc., to predetermined numerical ranges, and to mirror-polish the main surfaces, and also includes grinding, which is rough processing for performing relatively rough processing, to adjust the thickness of the substrate to a predetermined thickness, and to adjust flatness to a predetermined numerical range, for example.

As will be described later, in polishing for performing fine and precise processing, polishing pads are affixed to an upper surface plate and a lower surface plate, and surfaces of a substrate are polished while a polishing liquid containing loose abrasive particles is supplied between the substrate and the polishing pads. In grinding for performing rough shape processing, sheets (diamond sheets) to which comparatively rough abrasive particles (e.g., diamond abrasive particles) are fixed are affixed to the upper surface plate and the lower surface plate, and shape processing is performed while a coolant such as water is supplied between the substrate and the sheets, for example. Also, as another example of griding, the upper surface plate and the lower surface plate may be made of cast iron, and the surfaces of a substrate may be ground while a grinding liquid containing comparatively rough loose abrasive particles such as alumina abrasive particles is supplied between the substrate and the surface plates.

The following describes a case where a carrier for polishing is used in polishing for performing fine and precise processing.

Figure 1:
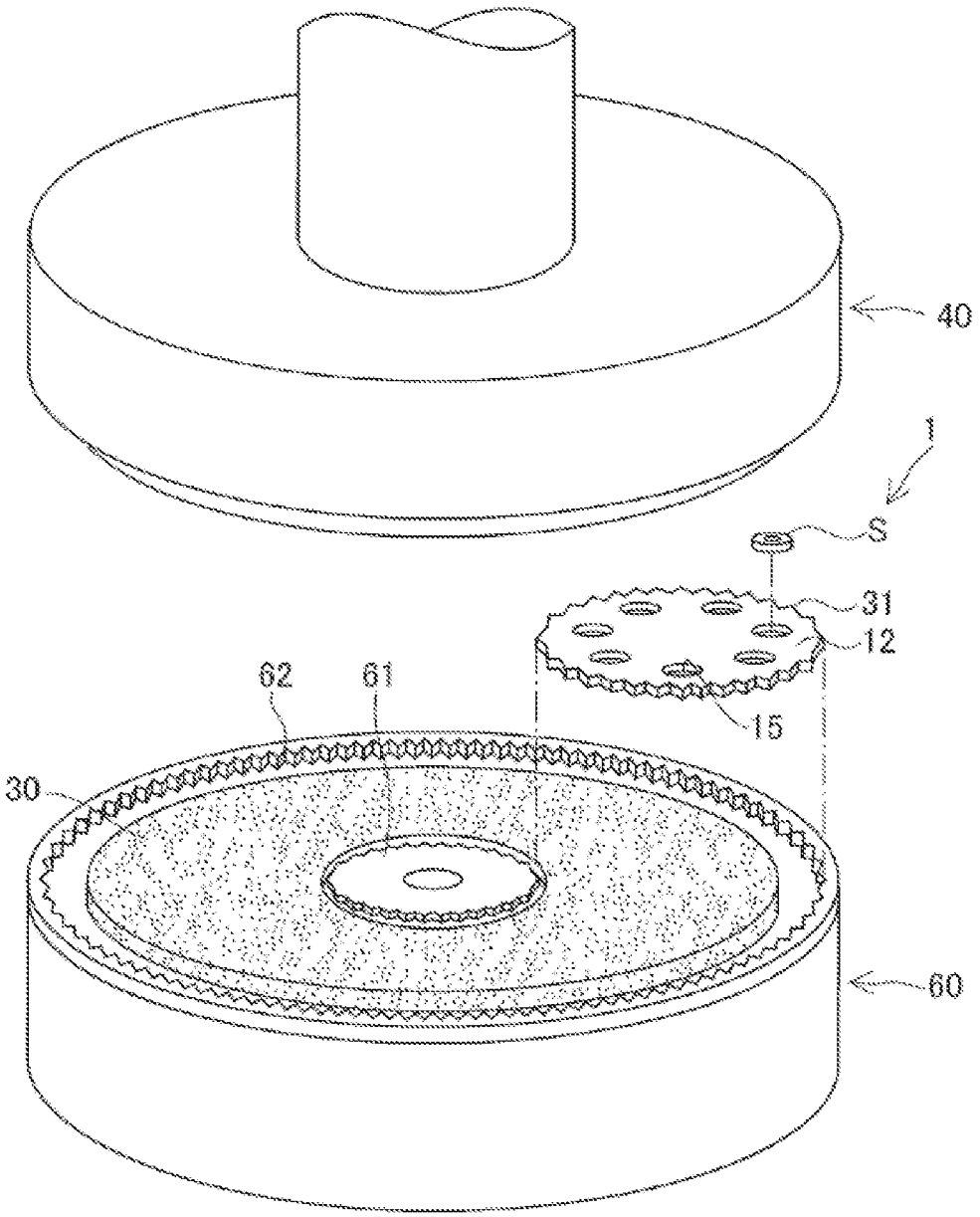
FIG. 1 is a diagram showing an overview of a polishing apparatus used in a method for manufacturing a substrate according to an embodiment.

FIG. 1 is a diagram showing an overview of a polishing apparatus 1 used in a method for manufacturing a substrate according to an embodiment.

In the polishing apparatus 1, polishing pads 30 are affixed to an upper surface of a lower surface plate 60 and a lower surface of an upper surface plate 40. The polishing pads 30 shown in FIG. 1 are formed into a sheet.

The polishing apparatus 1 is an apparatus that polishes a substrate S, using polishing pads provided on surfaces of the upper surface plate 40 and the lower surface plate 60, by sliding main surfaces of the substrate S against the polishing pads by moving the substrate S by rotating the upper surface plate 40 while the substrate S is sandwiched between the lower surface plate 60 and the upper surface plate 40.

A carrier 12 has substrate holding holes 15 for holding the disk-shaped substrates S when polishing processing is performed on the main surfaces of the substrates S while the substrates S are sandwiched between the upper surface plate 40 and the lower surface plate 60. The carrier 12 also includes teeth portions 31, which are provided on an outer circumferential portion thereof and engage with a sun gear 61 and an internal gear 62. The sun gear 61, the internal gear 62, which is provided along an outer edge, and the carrier 12, which has the teeth portions 31 and is disk-shaped, constitute a planetary gear mechanism centered around a rotation central axis of the upper surface plate 40. The teeth portions 31 of the disk-shaped carrier 12 engage with the sun gear 61 on the inner side of the polishing apparatus, engage with the internal gear 62 on the outer side of the polishing apparatus, and house and hold a plurality of substrates S. The carrier 12, which serves as a planetary gear, revolves while rotating on the lower surface plate 60, and as a result, the substrates S move relative to the lower surface plate 60. If the sun gear 61 rotates in the counterclockwise direction, for example, the carrier 12 rotates in the clockwise direction and the internal gear 62 rotates in the counterclockwise direction. As a result, the lower surface plate 60 and the substrates S move relative to each other. Similarly, the substrates S and the upper surface plate 40 move relative to each other.

During the above-described relative movement, the upper surface plate 40 is pressed against the substrates S held by the carrier 12 with a predetermined pressure (i.e., in the vertical direction), and as a result, the polishing pads 30 are pressed against the substrates S. Also, as shown in FIG. 1, a polishing liquid is supplied between the substrates S and the polishing pads 30 from a supply tank (not shown) via one or more pipes by a pump (not shown).

The main surfaces of the substrates S are polished using the above-described polishing apparatus 1.

Figure 2:
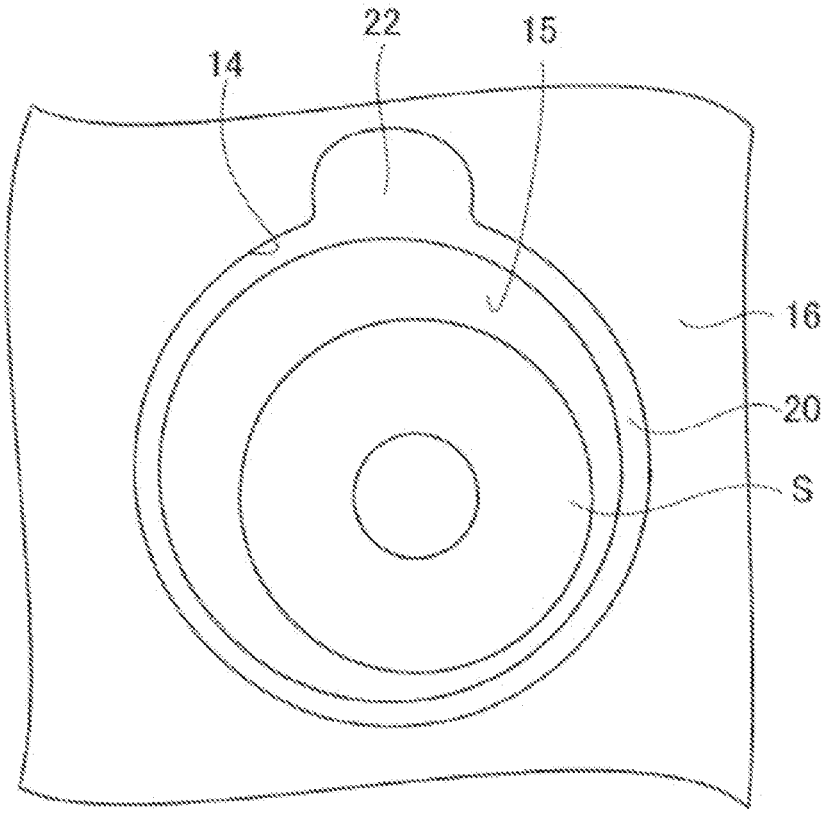
FIG. 2 is a diagram illustrating one example of an insertion member used in a carrier for polishing according to an embodiment.

FIG. 2 is a diagram showing an example of an insertion member 20 used in the carrier 12, in detail.

The carrier 12 includes a carrier main body 16 and the insertion members 20, and is used in polishing processing for polishing the main surfaces of the substrates S held in the substrate holding holes 15, which will be described later.

The carrier main body 16 is a plate-shaped member that has inner holes 14 and is made of a first material.

Figure 3A:
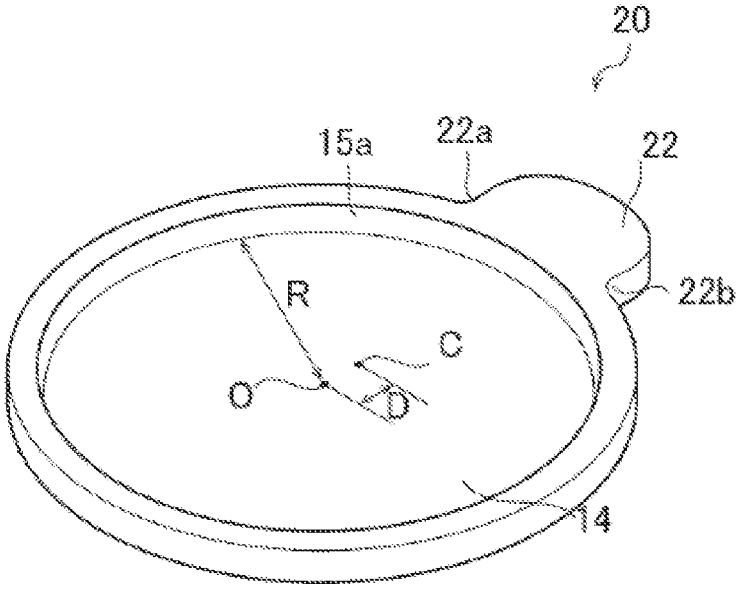
FIG. 3A is a diagram showing one example of an insertion member according to one embodiment.
Figure 3B:
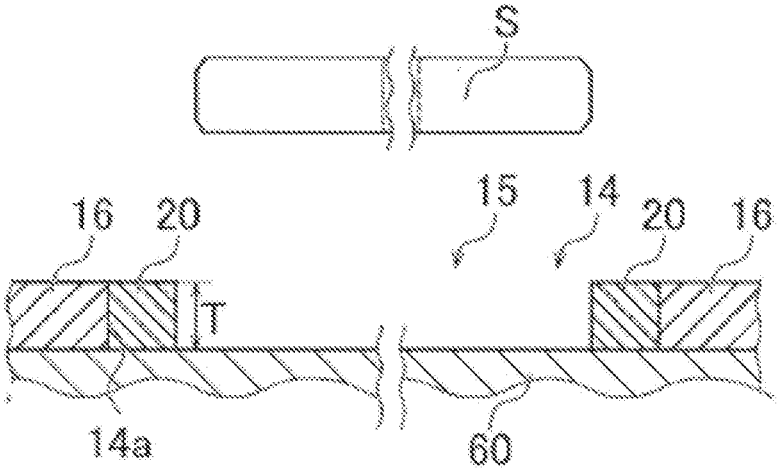
FIG. 3B is a diagram illustrating one example in which the insertion member is disposed in a carrier according to an embodiment.

Each insertion member 20 is shaped such that the insertion member 20 fits between a substrate S and an inner circumference 14*a* of the inner hole 14 (see FIG. 3B). The substrate S does not come into contact with the inner circumference 14*a* of the inner hole 14 of the carrier main body 16 due to the insertion member 20. Thus, the substrates S are not blemished by the carrier main body 16, and therefore, it is possible to increase the hardness of the carrier main body 16. The insertion member 20 is a member that has a substrate holding hole 15, which has an outer circumference that comes into contact with an inner circumference 14*a* of the inner hole 14, comes into contact with the outer circumference of a substrate S. and holds a substrate S while in contact with the outer circumference of the substrate S, and that is made from the second material that is different from the first material. The second material contains resin such as a plastic, for example, and the first material is metal or a reinforced plastic resin that contains a glass fiber, a carbon fiber, or an aramid fiber, lime, talc, or glass spheres, for example. Note that the above are merely examples, and resin may be used as the first material, and metal or a reinforced plastic resin may be used as the second material. Also, a resin such as polyester, polyamide, polyolefin. ABS, polystyrene, epoxy, phenol, unsaturated polyester, or polyimide can be used as the resin.

The carrier main body 16 is a portion obtained by removing the insertion members 20 from the carrier 12, for example.

The insertion member 20 has a region 22 that bulges toward the carrier main body 16 side (the outer side of the outer circumference, which is on the opposite side of the inner hole 14). The region 22 protrudes outward of the outer circumference of the insertion member 20.

The inner holes 14 provided in the carrier main body 16 each have a shape corresponding to an outer circumferential shape of the insertion member 20 that includes the region 22, and the inner holes 14 are configured such that the insertion members 20 can be disposed (fit) in the inner holes 14 of the carrier main body 16. Note that, although the outer circumference of the insertion member 20 can preferably be fitted to the inner circumference 14*a* of the inner hole 14 in the carrier main body 16 without a gap such that the insertion member is unlikely to come loose from the inner hole during polishing processing, a gap may be present partially therebetween. It is preferable that the length of a portion of the outer circumference of the insertion member 20 that does not come into contact with the inner circumference 14*a* of the inner hole 14 is 30% or less of the total length of the outer circumference of the insertion member 20.

FIG. 3A is a diagram showing an example of the insertion member 20 according to an embodiment. FIG. 3B is a diagram illustrating an example in which the insertion member 20 is disposed in the carrier main body 16.

The insertion member 20 has a substantially constant thickness (the length of the insertion member 20 in a direction perpendicular to the paper plane in FIG. 2), and as shown in FIG. 3A, the insertion member 20 has the region 22 on the outer circumference thereof. The region 22 shown in FIG. 3A protrudes outward in a radial direction from a portion that has a constant width along the circumference thereof and whose outer circumference forms an are shape.

When the radius of an inscribed circle that is inscribed to an inner circumference 15*a* (see FIG. 3A) of the substrate holding hole 15 of the insertion member 20 is R, a center of gravity C of the insertion member 20 is located 0.1·R or more (0.1×R or more) away from a center O of the inner circumferential shape of the insertion member 20. That is, a positional shift D shown in FIG. 3A corresponds to the length of 0.1×R or more (i.e., 10% or more of the length R of the radius of the inscribed circle). The positional shift D is due to the region 22. Because the thickness (the length of the insertion member 20 in a direction perpendicular to the paper plane in FIG. 2) of the insertion member 20 is constant, the position of the center of gravity corresponds to the position of the center of the drawing on a plane parallel to the above-described inscribed circle. The position of the center of gravity C of the insertion member 20 and the distance of the positional shift D can be calculated using three-dimensional CAD software, for example.

If the inner circumference 15*a* of the substrate holding hole 15 of the insertion member 20 is to hold a circular substrate S, as shown in FIG. 3A, the inner circumferential shape of the substrate holding hole 15 is circular. Thus, the center O is also the center of the inscribed circle.

Note that, if the substrate S is rectangular and the inner circumferential shape of the insertion member 20 is also rectangular, the center O thereof can be an intersection point of two diagonal lines of the inner circumferential shape of the insertion member 20. Also, if the inner circumferential shape of the insertion member 20 is another polygonal shape or a partially deformed shape, the center of an inscribed circle having as many points of contact as possible with the inner circumferential shape can be set to the center O. Note that the inscribed circle may be an ellipse.

A diameter (2R) of the inscribed circle of the substrate holding hole 15 is slightly larger than an outer diameter (the diameter) of the substrate S to be polished, and preferably, the diameter 2R is larger than the outer diameter of the substrate S by about 0.5 to 10 mm, for example.

It is preferable that the width of a portion of the insertion member 20 other than the region 22 is at least 0.5 mm or more. If this width is less than 0.5 mm, the insertion member 20 may break during processing. On the other hand, if the width is excessively large, the number of substrates S that can be held in one carrier main body 16 decreases, and thus the width is preferably 10 mm or less.

A thickness T (see FIG. 3B) of the insertion member 20 is preferably close to the thickness of the carrier main body 16, and the thickness T is 80% to 120% of the thickness of the carrier main body 16, for example.

The insertion member 20 is preferably made from a material (the second material) whose hardness is lower than that of the material of the carrier main body 16 (the first material) because the occurrence of blemishes on an outer circumferential edge surface of the substrate S can be easily suppressed. Also, the hardness of the insertion member 20 is more preferably lower than the hardness of the substrate S for the same reasons. If the outer circumferential edge surface of the substrate S is blemished, microparticles such as polishing abrasive particles may be captured thereby, and, after polishing, adhere to the main surfaces of the substrate S to be polished and blemish the main surfaces. That is, the insertion member 20 is used in order to prevent the outer circumferential edge surface of the substrate S from being blemished or chipped during polishing processing. Here, Young's modulus can be used to measure hardness, for example. The Young's modulus of the material (first material) of the carrier main body 16 is 2 GPa or more, for example. Also, the Young's modulus of the insertion member 20 is 5 GPa or less, for example. Note that examples of the Young's modulus of various materials are as follows: the Young's modulus of an aluminum alloy substrate or a glass substrate is about 60 to 110 GPa, the Young's modulus of a glass-fiber reinforced resin is about 3 to 10 GPa, the Young's modulus of stainless steel is about 500 to 700 GPa, and the Young's modulus of ordinary resin is 5 GPa or less.

In polishing processing, the substrate S is moved relative to the upper surface plate 40 while the upper surface plate 40 applies a predetermined load to the substrate S. The thicknesses of the carrier main body 16 and the insertion member 20 are determined such that the main surfaces of the substrate S protrude with respect to the carrier main body 16 and the insertion member 20 (i.e., the thicknesses of the carrier main body 16 and the insertion member 20 are smaller than the thickness of the substrate S). Therefore, the insertion member 20 is likely to attach to (adsorb to) the upper surface plate 40 due to reasons including the insertion member 20 becoming thinner and lighter as the thickness of the substrate S decreases, the surface of the polishing pads 30 having multiple holes and the polishing pads 30 being flat and flexible, the insertion member 20 and the polishing pads becoming wet due to the polishing liquid or the like, thus generating surface tension, and the insertion member 20 not being fixed to the upper surface plate 40 or the lower surface plate 60 and thus being able to move freely therebetween.

However, as a result of providing the region 22, the insertion member 20 has an anisotropic shape in which the center of gravity is shifted from the center of the inner circumferential shape (i.e., a circular shape), and thus, even if the insertion member 20 is attached to the upper surface plate 40 when the upper surface plate 40 is raised after polishing processing has ended, the center of gravity of the insertion member 20 has the above-described positional shift D, and the weight of the insertion member 20 is uneven, as a result of which, the insertion member 20 can separate from the interface at which the insertion member 20 and the upper surface plate 40 are attached to each other. In other words, the entire insertion member 20 that is stably adsorbed to the upper surface plate becomes unbalanced in response to a portion of the insertion member 20 first separating from the upper surface plate due to the above positional shift D), and then a region that has separated due to gravity quickly spreads over the entire insertion member 20. Thus, the insertion member 20 can be separated from the upper surface plate. If the distance between the center of gravity of the insertion member 20 and the center of the inner circumferential shape of the insertion member 20 is less than 0.1×R, momentum originating from the weight of the above-described insertion member 20 is small because the above-described shift is small, and the insertion member 20 will be unlikely to separate from the upper surface plate 40. Thus, the main surfaces of the substrate may be blemished when the substrate attached to the upper surface plate moves upward by a certain distance and then falls therefrom. From the above viewpoint, the positional shift D is preferably 0.2×R or more, and more preferably 0.3×R or more. On the other hand, if the D is excessively large, the number of substrates S held in one carrier is reduced and the rigidity of the overall carrier is also reduced. Therefore, the D is preferably 2.0×R or less, and more preferably 1.0×R or less.

Although the number of regions 22 that are provided in the insertion member 20 shown in FIGS. 2 and 3A and bulge toward the carrier main body 16 side is one, the number of regions 22 is not limited to one. The number of regions 22 may be two, three, or four as long as the positional shift D is set to 0.1×R or more.

Also, the outer circumferential shape of the region 22 is not limited to a shape formed of a portion of a circular shape or an elliptical shape as shown in FIG. 3A, and the outer circumferential shape thereof may be a polygon or a polygon with a round corner, or a shape obtained by combining a portion of a circular shape or an elliptical shape and a polygon or a polygon with a round corner, and the outer circumferential shape thereof is not particularly limited.

Figure 5:
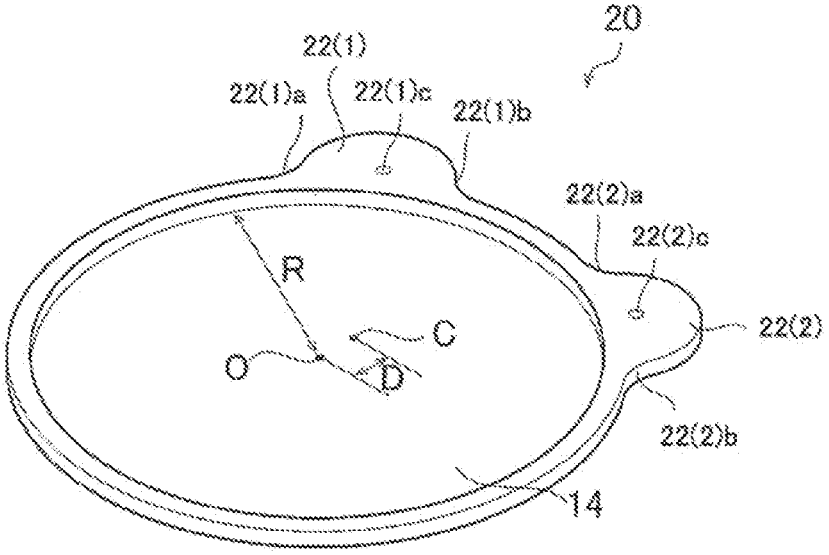
FIG. 5 is a diagram showing another example of an insertion member according to an embodiment.

If the region 22 that bulges toward the carrier main body 16 side is provided as a protruding portion, two or more protruding portions may be provided. From the viewpoint of increasing the number of substrates held in one carrier, the number of protruding portions is preferably large because the area of one protruding portion can be reduced. However, from the viewpoint of the productivity of insertion members, the number of protruding portions is preferably 10 or less, and more preferably 5 or less, for example. FIG. 5 shows an example of the insertion member 20 having two protruding portions.

The shape of the insertion member 20 is not limited to the shape resulting from the region 22 being provided on the outer circumference of a portion of a substantially annular portion such as that shown in FIGS. 2 and 3A, and may be a shape resulting from the region 22 being provided on the outer circumference of a portion obtained by providing the substrate holding hole 15 in an inner portion of a substantially rectangular shape.

According to the embodiment, the hardness of the second material of the insertion member 20 is preferably lower than the hardness of the first material of the carrier main body 16. Accordingly, it is possible to suppress the occurrence of blemishes on the outer circumferential edge surface of the substrate S. The hardness is represented as a Young's modulus, or a Vickers hardness (conforming to JIS Z 2244: 2009), for example.

According to the embodiment, the size (the area) of the region 22 that bulges toward the carrier main body 16 side is preferably smaller than the size (the area) of the substrate S. If the size of the region 22 is equivalent to the substrate S or is larger than the size of the substrate S, the size of the inner holes 14 of the carrier main body 16 also increases, and thus the rigidity of the carrier 12 is likely to be low. Also, because the inner holes 14 of the carrier main body 16 are increased, the number of substrates S that can be held by one carrier 12 decreases, and productivity decreases.

Note that the number of substrates S held in the substrate holding hole 15 of one insertion member 20 is preferably one. If a plurality of substrates S are held in the substrate holding hole 15 of one insertion member 20, in order to avoid collision of the plurality of substrates S during polishing, the substrate holding hole 15 includes a plurality of holes for respectively holding the substrates S, and narrow connection holes that connect the plurality of holes. In this case, there is a risk that the rigidity of the carrier 12 will decrease in surrounding regions (connection holes) between the plurality of substrates S because a portion of each connection hole is a region without a member for ensuring rigidity, such as the carrier main body 16 or the insertion member 20.

Also, the number of substrate holding holes 15 formed in one insertion member 20 is preferably one. In other words, the number of substrates S held by one insertion member 20 is preferably one. If a plurality of substrate holding holes 15 are formed in one insertion member 20 and the substrates S are respectively held in the substrate holding holes 15, there is a risk that the rigidity of the carrier 12 will decrease because the width of the insertion member 20 extending between a plurality of substrate holding holes 15 is reduced.

According to one embodiment, it is preferable that the length occupied by the region 22 that bulges toward the carrier main body 16 side, extending along the inner circumference 15*a* of the substrate holding hole 15 is 5% to 50% of the entire circumferential length of the inner circumference 15*a*. By setting the occupation length to 5% to 50% of the entire circumferential length of the inner circumference 15*a*, the extent to which the shape of the insertion member 20 is anisotropic can be increased, and the insertion member 20 can be made more likely to separate from the upper surface plate 40. If the region 22 is provided on the outer circumference of a substantially annular portion such as that shown in FIGS. 2 and 3A, the length occupied by the region 22, extending along the inner circumference 15*a*, refers to the length of the inner circumference 15*a* of the substrate holding hole 15 between two intersection points, which are formed between two lines that connect protruding base portions (22*a*, 22*b*) located on two sides of the region 22 in a plan view to the center O of the inner circumference 15*a*. In other words, the occupation length refers to a ratio of the width of the base portion of the protruding portion (region 22) relative to the entire circumferential length of the inner circumference 15*a*.

Figure 4:
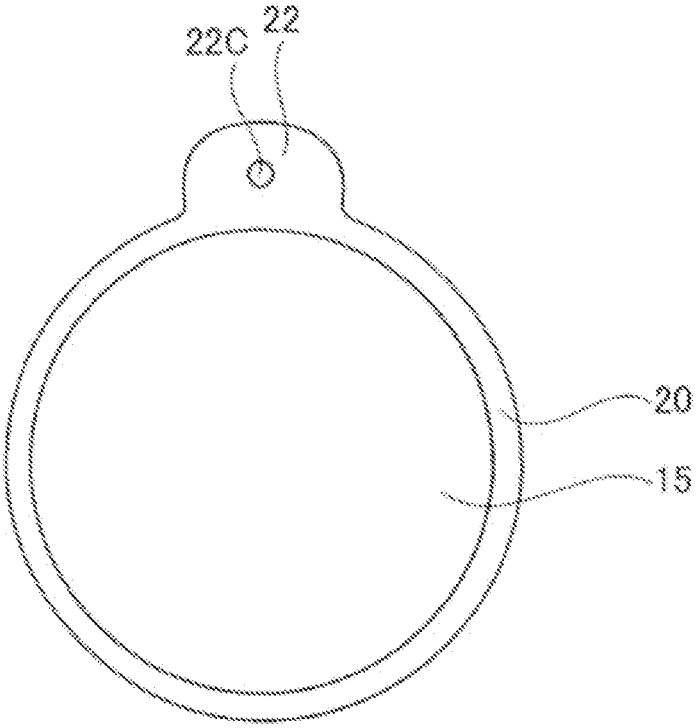
FIG. 4 is a diagram showing another example of an insertion member according to an embodiment.

FIG. 4 is a diagram showing another example of the insertion member 20 according to an embodiment. According to the embodiment, as shown in FIG. 4, it is preferable that the region 22 is provided with a through-hole 22*c* that passes through the insertion member 20 in the thickness direction of the insertion member 20. As a result of providing the through-hole 22*c*, a polishing liquid or a grinding coolant can be made to flow between the upper surface plate 40 and the lower surface plate 60, the polishing liquid or the grinding coolant can be evenly supplied to the substrates S, and the occurrence of a difference in polishing rates on both sides (an upper side and a lower side) of the substrates S can be suppressed. The shape of the through-hole 22*c* is not limited to a round shape, and may be a polygon such as a triangle or a rectangle, or an irregular shape.

Also, FIG. 5 is a diagram showing another example of the insertion member 20 according to an embodiment. According to an embodiment, it is preferable that, as shown in FIG. 5, two regions 22(1) and 22(2) are respectively provided as protruding portions, and the region 22(1) is provided with a through-hole 22(1)*c* that passes through the insertion member 20 in the thickness direction thereof, and the region 22(2) is provided with a through-hole 22(2)*c* that passes through the insertion member 20 in the thickness direction thereof. By providing the through-holes 22(1)*c* and 22(2)*c*, a polishing liquid or a grinding coolant can be allowed to flow between the upper surface plate 40 and the lower surface plate 60, the polishing liquid or the grinding coolant can be evenly supplied to the substrates S, and the occurrence of a difference in processing rates on both sides (an upper side and a lower side) of the substrates S can be suppressed. The shapes of the through-holes 22(1)*c* and 22(2)*c* are not limited to a round shape, and may be a polygon such as a triangle or a rectangle, or an irregular shape.

It is preferable that the material (the first material) of the carrier main body 16 contains metal, and the material (the second material) of the insertion members 20 contains resin. Because the insertion members 20 contain resin, it is possible to suppress damage to the outer circumferential edge surfaces of the substrates S.

Although the above-described insertion members 20 are not fixed to the carrier main body 16, according to the embodiment, the insertion members 20 and the carrier main body 16 may be fixed to each other at portions where the insertion members 20 and the carrier main body 16 come into contact with each other, through adhesion using an adhesive, or engagement between a recess and a protrusion in the thickness direction. Even if the insertion members 20 are fixed to the carrier main body 16 using an adhesive, or if a recess and a protrusion are formed in the thickness direction to make the insertion members 20 unlikely to come loose from the carrier main body 16, the insertion members 20 and the carrier main body 16 are made of different materials, and the insertion members 20 are thin, and thus there is a risk that the insertion members 20 will come loose from the carrier main body 16 during polishing processing. Even if an insertion member 20 comes loose from the carrier main body 16, it is possible to prevent the insertion member 20 that has come loose from the carrier main body 16 from falling onto the substrate S because the insertion member 20 is provided with the region 22 such that the center of gravity of the insertion member 20 is located 0.1×R or more away from the center of the inner circumferential shape of the substrate holding hole 15.

Surface unevenness of the main surfaces of the substrates S is set within a target range through processing for polishing the main surfaces of the substrates S using such a carrier 12. That is, when the substrates S are manufactured using a method that includes polishing processing for polishing the main surfaces of the substrates S using a carrier that is provided with substrate holding holes and holds the substrates S in the substrate holding holes, the above-described carrier for polishing 12 can be used as the carrier. A glass substrate, an aluminum alloy substrate, a Si-substrate, a silicon wafer, and the like can be used as the substrate S, and there is no particular limitation on the material of a substrate. Also, the shapes of the substrates S are not limited to a round shape, and the outer circumferential shape thereof may be a triangle or a rectangle, other polygons, combinations of free curves and various shapes described above, or the like, and there is no particular limitation on the outer circumferential shape.

An example will be described in which a glass substrate, or in particular, a glass substrate for a magnetic disk is used as the substrate S in the later-described method for manufacturing a substrate.

First, processing for forming a glass blank that serves as a raw material of a plate-shaped substrate S having a pair of main surfaces is performed. Then, rough grinding is performed on this glass blank. Shape processing and edge surface polishing are then performed on the glass blank. Precision grinding is then performed on main surfaces of the substrate S obtained from the glass blank, using fixed abrasive particles. Then, first polishing is performed on the main surfaces of the substrate S, chemical strengthening is performed on the substrate S, and second polishing is performed on the main surfaces of the substrate S. Note that, although the substrate S is manufactured in the above-described flow, it is not necessary to always perform the above-described processes, and these processes may be omitted as appropriate. In the above-described processes, edge surface polishing, precision grinding, first polishing, chemical strengthening, and second polishing need not be carried out, for example. Hereinafter, each of the processes will be described.

(a) Forming of Glass Blank

A press molding method may be used to mold a glass blank, for example. A circular glass blank can be obtained using the press molding method. Also, a glass blank may be manufactured using a known manufacturing method such as a downdraw method, a redraw method, or a fusion method. A disk-shaped substrate, which is the base of a magnetic-disk substrate, can be obtained by appropriately performing shape processing on the plate-shaped glass blank produced using these known manufacturing methods.

(b) Rough Grinding

In rough grinding, the main surfaces on both sides of the glass blank are ground. Loose abrasive particles are used as a grinding material, for example. In rough grinding, grinding is performed such that the glass blank is brought approximately closer to a target substrate thickness and a target flatness of the main surfaces. Note that rough grinding is performed according to the dimensional accuracy or the surface roughness of the molded glass blank, and may be omitted in some cases.

(c) Shape Processing

Next, shape processing is performed. In the shape processing, after the glass blank is molded, a circular hole is formed using a known processing method to obtain a disk-shaped substrate S having a circular hole. Then, edge surfaces of the substrate S are chamfered. Accordingly, a side wall surface orthogonal to the main surfaces and chamfered surfaces that are inclined with respect to the main surfaces and located between the side wall surface and the main surfaces on both sides are formed on the edge surfaces of the substrate S.

(d) Edge Surface Polishing

Next, edge surface polishing is performed on the substrate S. Edge surface polishing is processing for performing polishing by supplying a polishing liquid containing loose abrasive particles between a polishing brush and the outer circumferential edge surfaces (the side wall surface and the chamfered surfaces) and the inner circumferential edge surfaces (the side wall surface and the chamfered surfaces) of the substrate, and moving the polishing brush and the substrate relative to each other. In edge surface polishing, an inner circumferential edge surface and an outer circumferential edge surface of the substrate are polishing targets, and the inner circumferential edge surface and the outer circumferential edge surface are formed into mirror surfaces. Note that edge surface polishing need not be performed in some cases.

(e) Precision Grinding

Next, precision grinding is performed on the main surfaces of the substrate S. Grinding is performed on the main surfaces of the substrate S held in the substrate holding hole 15 of the above-described carrier 12, using a double-side grinding apparatus provided with the above-described planetary gear mechanism, for example. In this case, grinding is performed using surface plates provided with fixed abrasive particles, for example. Alternatively, grinding may also be performed using loose abrasive particles. Note that precision grinding need not be performed in some cases.

(f) First Polishing

Next, first polishing is performed on the main surfaces of the substrate. The main surfaces of the substrate after first polishing is performed are preferably mirror-surfaces. First polishing is performed using loose abrasive particles and polishing pads 30 affixed to the surface plates. First polishing removes cracks and warping remaining on the main surfaces in the case where precision grinding is performed with fixed abrasive particles, for example. In first polishing, the surface roughness of the main surfaces, or, for example, an arithmetic average roughness Ra, can be reduced by polishing, for example, using a double-side polishing apparatus provided with the above-described planetary gear mechanism, the main surfaces of the substrates S held in the substrate holding holes 15 of the above-described carrier 12 while preventing the shape of the edge portions of the main surfaces of the substrate S from being excessively recessed or excessively protruding. Although there is no particular limitation on the loose abrasive particles used in first polishing, cerium oxide abrasive particles, zirconia abrasive particles, or the like are used, for example. Also, it is preferable to use suede polishing pads. Note that first polishing need not be performed in some cases.

(g) Chemical Strengthening

Although chemical strengthening is not performed on the substrate S according to this embodiment, chemical strengthening may be performed as appropriate depending on the substrate S. If chemical strengthening is performed, a melt obtained by heating potassium nitrate, sodium nitrate, or a mixture thereof, for example, may be used as a chemical strengthening liquid. Also, by immersing the substrate in the chemical strengthening liquid, lithium ions and sodium ions in the glass composition that are present in a surface layer of the substrate are respectively substituted with sodium ions and potassium ions whose ion radii are relatively large, in the chemical strengthening liquid, whereby compressive stress layers are formed on the surface layer portions and the substrate is strengthened.

Although the timing at which chemical strengthening is performed may be determined as appropriate, the polishing is particularly preferably performed after chemical strengthening, because the surface can be smoothed and foreign matter attached to the surface of the substrate can be removed through chemical strengthening.

(h) Second Polishing (Mirror-Polishing)

Next, second polishing is performed on the substrate. Second polishing is for performing mirror-polishing on the main surfaces of the substrate S. In second polishing as well, polishing is performed on the main surfaces of the substrates S held in the substrate holding holes 15 of the above-described carrier 12 using a double-side polishing apparatus having a configuration similar to that in first polishing. In second polishing, the type and the particle size of loose abrasive particles are changed relative to first polishing and mirror polishing is performed using resin polishers having a low hardness as the polishing pads 30. It is preferable to use colloidal silica as the loose abrasive particles. It is preferable that the particle size of colloidal silica is smaller than the particle size of abrasive particles used in first polishing. Also, it is preferable to use suede polishing pads. Doing so makes it possible to further reduce the roughness of the main surfaces of the substrate S with respect to the roughness thereof after first polishing is performed, while preventing the shape of edge portions of the main surfaces from being excessively recessed or excessively protruding. The main surfaces obtained after second polishing preferably have an arithmetic average Ra (JIS B 0601 2001) of 0.3 nm or less.

A substrate S whose surface unevenness is in a target range can then be obtained by cleaning the substrate. Surface unevenness required of a glass substrate for a magnetic disk can be realized, for example.

Although the carrier 12 is used in the above-described first polishing and second polishing, the carrier 12 need only be used in at least one of the first polishing and the second polishing. Also, the carrier 12 may be used as a carrier for holding a glass blank or the substrate S in the double-side grinding apparatus used in the above-described rough grinding or precision grinding. Note that, although the carrier of this embodiment can be used in a single-side polishing device or a single-side grinding device, it is preferable to use the carrier in a double-side polishing apparatus or a double-side grinding apparatus of a planetary gear type, in particular. This is because, with such a double-side polishing apparatus or double-side grinding apparatus, the carrier 12 cannot be fixed to one of the surface plates when separating the upper and lower surface plates after processing is complete, and thus the insertion members 20 may adhere to either surface plate.

As described above, when polishing processing is performed on the main surfaces of the substrates S while the carrier 12 provided with the insertion members 20 between the substrates S and the inner circumferences 14*a* of the inner holes 14 is sandwiched between the upper surface plate 40 and the lower surface plate 60, the center of gravity C of each insertion member 20 is located 0.1×R or more away from the center O of the inner circumferential shape (the inscribed circle) of the insertion member 20, thus suppressing attachment of the insertion member 20 to the upper surface plate 40.

EXAMPLES AND COMPARATIVE EXAMPLES

The following carrier was prepared. A carrier main body having a plate thickness of 0.4 mm and made of stainless steel was prepared. One carrier had five inner holes so as to be able to hold five substrates, and their shapes were adjusted such that there was no gap between the insertion members and the carrier main body. The insertion member was made from a glass fiber-containing epoxy resin and had a plate thickness of 0.4 mm, the holding hole had a circular shape having a diameter of 98 mm (thus, the diameter of the inscribed circle was 98 mm), and the width of a non-protruding portion was 2 mm. Note that the following insertion members having various numbers of protruding portions and various sizes were prepared and used in combination.

Insertion member (a): The number of protruding portions was 1 (the leading end thereof protruded in a substantially elliptical shape, no holes were provided, and the protruding portion was disposed so as to face the outer side of the carrier (gear side)), the protruding length of the protruding portion was adjusted such that the occupation length of the protruding portion was 15%, and the distance of positional shift D=0.1 R, 0.2 It, 0.3 It, or 0.5 R.

Insertion member (b): The number of protruding portions was 2 (the leading ends thereof protruded in a substantially are shape, no holes were provided, the two protrusions had the same shape, and the protruding portions were disposed such that the center of each protruding portion was located 90 degrees away from the center O of the holding hole in the circumferential direction, and the protrusions faced the outer side of the carrier (gear side)), the protruding length of the protruding portion was adjusted such that the occupation length of each protruding portion was 8% (16% in total), and the distance of positional shift D=0.3×R or 0.5×R.

Insertion member (c): No protruding portion (ring shape with a width of 2 mm).

Glass substrates (annular magnetic-disk glass substrates each having an outer diameter of 97 mm, an inner diameter of 25 mm, and a plate thickness of 0.635 mm) that were subjected to processing up to the first polishing step were prepared, 1000 glass substrates were polished using the carrier including each of the above insertion members in the second polishing step (using colloidal silica abrasive particles and suede pads). The polished glass substrates were cleaned, and the ratio of occurrence of blemishes on the main surfaces of the substrates caused by the insertion member falling onto the substrate was examined by visually observing the surfaces of all of the substrates.

TABLE 1

| | Insertion Member | D | Ratio of Occurrence of Blemishes on Main Surfaces of Substrates |
|---|---|---|---|
| Ex. 1 | (a) | 0.1 R | 5.2 |
| Ex. 2 | | 0.2 R | 4.4 |
| Ex. 3 | | 0.3 R | 2.3 |
| Ex. 4 | | 0.5 R | 1.5 |
| Ex. 5 | (b) | 0.3 R | 2.1 |
| Ex. 6 | | 0.5 R | 1.4 |
| Comp. Ex. | (c) | 0 | 9.0 |

When the distance D of positional shift was 0.1×R or more, the ratio of occurrent of blemishes on the main surfaces of the glass substrates greatly decreased. It was confirmed that the ratio of occurrent of blemishes on the main surfaces of the glass substrates can be reduced by increasing the distance D of positional shift. Also, it was found that use of an insertion member provided with two protruding portions provide equivalent results or better results than an insertion member provided with one protruding portion.

As described above, although a carrier for polishing and a method for manufacturing a substrate according to the present invention have been described in detail, the present invention is not limited to the above-described embodiments, and it will be appreciated that various improvements and modifications can be made without departing from the gist of the present invention. The substrate S according to the present invention is not limited to the above HDD substrate, and various substrates such as substrates for cover glass, substrates for mask blanks, substrates for light-guiding plates, substrates for supporting semiconductors, and other substrates for a semiconductor device can be used, for example.

The invention claimed is:

1. A carrier that is provided with a substrate holding hole and is configured to hold a substrate in the substrate holding hole and to be used in processing for polishing or grinding a main surface of the substrate, the carrier comprising:

a plate-shaped carrier main body that has an inner hole and is made of a first material; and an insertion member that is shaped such that the insertion member fits between the substrate and an inner circumference of the inner hole, that has the substrate holding hole for holding the substrate, and that is made of a second material that is different from the first material, wherein the insertion member includes a non-protruding portion that has a constant radial width along a circumference of the insertion member and a protrusion portion that protrudes outward from an outer circumference of the non-protruding portion, a center of gravity of the insertion member is shifted from a center of an inner circumferential shape of the substrate holding hole due to the protrusion portion, and when a radius of an inscribed circle inscribed to an inner circumference of the substrate holding hole of the insertion member is R, the center of gravity of the insertion member is located 0.1×R or more away from the center of the inner circumferential shape of the substrate holding hole of the insertion member.

2. The carrier according to claim 1, wherein hardness of the second material is lower than that of the first material.

3. The carrier according to claim 1, wherein a size of the protrusion portion is smaller than a size of the substrate.

4. The carrier according to claim 1, wherein a length occupied by the protrusion portion extending along the inner circumference of the substrate holding hole is 5% to 50% of the total circumferential length of the inner circumference.

5. The carrier according to claim 1, wherein the protrusion portion is provided with a through-hole passing through the insertion member in a thickness direction of the insertion member.

6. The carrier according to claim 1, wherein the first material contains metal, and the second material contains resin.

7. The carrier according to claim 1, wherein the insertion member and the carrier main body are fixed to each other through adhesion using an adhesive, or engagement between a recess and a protrusion in a thickness direction, at portions where the insertion member and the carrier main body are in contact with each other.

8. A method for manufacturing a substrate, the method comprising processing for polishing or grinding a main surface of a substrate using a carrier that is provided with a substrate holding hole and is configured to hold the substrate in the substrate holding hole, wherein the carrier is the carrier according to claim 1.

9. A carrier that is provided with a substrate holding hole and is configured to hold a substrate in the substrate holding hole and to be used in processing for polishing or grinding a main surface of the substrate, the carrier comprising:

a plate-shaped carrier main body that has an inner hole and is made of a first material; and an insertion member that is shaped such that the insertion member fits between the substrate and an inner circumference of the inner hole, that has the substrate holding hole for holding the substrate, and that is made of a second material that is different from the first material, wherein the insertion member has a non-protruding portion that has a constant radial width along a circumference of the insertion member and a region that bulges from an outer circumference of the non-protruding portion toward the carrier main body, and when a radius of an inscribed circle inscribed to an inner circumference of the substrate holding hole of the insertion member is R, a center of gravity of the insertion member is located 0.1×R or more away from a center of an inner circumferential shape of the substrate holding hole of the insertion member, and the region is provided with a through-hole passing through the insertion member in a thickness direction of the insertion member.

10. The carrier according to claim 9, wherein hardness of the second material is lower than that of the first material.

11. The carrier according to claim 9, wherein a size of the region is smaller than a size of the substrate.

12. The carrier according to claim 9, wherein a length occupied by the region extending along the inner circumference of the substrate holding hole is 5% to 50% of the total circumferential length of the inner circumference.

13. The carrier according to claim 9, wherein the first material contains metal, and the second material contains resin.

14. The carrier according to claim 9, wherein the insertion member and the carrier main body are fixed to each other through adhesion using an adhesive, or engagement between a recess and a protrusion in the thickness direction, at portions where the insertion member and the carrier main body are in contact with each other.

15. A method for manufacturing a substrate, the method comprising processing for polishing or grinding a main surface of a substrate using a carrier that is provided with a substrate holding hole and is configured to hold the substrate in the substrate holding hole, wherein the carrier is the carrier according to claim 9.

* * * * *